US006418569B1

(12) United States Patent
Knight

(10) Patent No.: US 6,418,569 B1
(45) Date of Patent: Jul. 16, 2002

(54) WASTE OUTLET

(76) Inventor: Rodney Paul Knight, 1/42 Zita Maria Drive, Massey (NZ)

( * ) Notice: Subject to any disclaimer, the term of this patent is extended or adjusted under 35 U.S.C. 154(b) by 0 days.

(21) Appl. No.: 09/647,602

(22) PCT Filed: Apr. 1, 1999

(86) PCT No.: PCT/NZ99/00040

§ 371 (c)(1),
(2), (4) Date: Nov. 20, 2000

(87) PCT Pub. No.: WO99/51824

PCT Pub. Date: Oct. 14, 1999

(30) Foreign Application Priority Data

Apr. 3, 1998 (NZ) ..... 330123

(51) Int. Cl.[7] ..... A47K 1/14; E03C 1/26
(52) U.S. Cl. ..... 4/287; 4/679
(58) Field of Search ..... 4/286–292, 613, 4/679; 210/163; 137/247.35, 247.37, 247.39

(56) References Cited

U.S. PATENT DOCUMENTS

| | | | | | |
|---|---|---|---|---|---|
| 782,760 | A | * | 2/1905 | Savard | 4/289 |
| 951,795 | A | * | 3/1910 | Berwanger | 4/292 |
| 2,101,978 | A | * | 12/1937 | Boosey | 137/247.35 X |
| 4,045,346 | A | * | 8/1977 | Swaskey | 137/247.39 X |

* cited by examiner

*Primary Examiner*—Charles E. Phillips
(74) *Attorney, Agent, or Firm*—Young & Thompson

(57) ABSTRACT

A waste outlet has a clamping ring which seats a flared filler tube. The tube directs water into a well in which the water rises and overflows into the bowl of the outlet. The filler tube contains a solids filter disc which is connected to the filler tube. When the cover is removed, the tube and the disc are removable as a pair. The disc cleans the well as it is retracted. The disc drops clear of the tube allowing the disc to be cleaned before re-insertion. A version for spa baths has a screw operated disc for making the outlet function as a plug. A rectangular grooved drainage plate for draining tiles directly through slots in the ring is provided with the waste outlet as a version for shower slabs.

21 Claims, 4 Drawing Sheets

WASTE OUTLET

BACKGROUND OF THE INVENTION

This invention concerns waste outlets for plumbing systems.

DESCRIPTION OF THE RELATED ART

Waste outlets admit waste water form shower cabinets into the waste water pipework. In multi storey buildings a single downpipe or stack may drain a series of showers and toilets. The fluctuations in pressure in the downpipe cause an extractive or draining effect upon the waste outlets. This tends to leave inadequate waste water levels in the outlets.

The existing waste outlets have a spider which retains some hair and soap insolubles. This obliges people to use dangerous cleaning chemicals such as caustic soda. If a blockage then occurs the plumber must deal with a blockage containing a pocket of dangerous chemicals. It would be advantageous to be able to remove the trapped material more easily than retrieving it from the spider. An Australian/New Zealand Standard pertains to waste outlets which some outlets presently fail to meet, namely provision for ensuring adequate water remains to provide the trap.

Australian Patent # 635 613 describes a waste outlet with a central sypherical chamber which houses the water trap but the outlet is on the same axis as the inlet and no provision is made for convenient cleaning.

SUMMARY OF THE INVENTION

This invention addresses the above problem.

This invention provides a waste outlet of the type described comprising a bowl with an outlet which is capable of connection to a waste pipe and means to locate the bowl in relation to the surface to be drained, a drainage cover for the bowl and a filter nesting in the bowl which is connected to the cover and removable from the bowl for cleaning.

Preferably the bowl has a mouth which screws into the bowl and the drainage cover seats on the mouth. The mouth may include a seal against the bowl so that a water proof connection is made with the shower tray. The bowl may have a reservoir in which the filter nests immersed and which remains full of water permanently despite pressure changes in the pipes.

The filter may be connected to the mouth so that both lift out seriatim. The filter may also be connected to a strainer which also lifts out, both strainer and filter nesting within the reservoir. The mouth may have a flange which retains the drainage cover. The cover is perforated with drainage apertures which tend to act as a first barrier to hair, labels etc. This may be side receiving rather than top receiving.

The strainer and filter lie almost completely immersed in the waste water of the reservoir. The bowl has an outlet spigot which may be threaded or otherwise prepared to couple with a waste tube. The outlet is separated from the mouth of the bowl by the filter.

PREFERRED EMBODIMENTS

One embodiment of the invention is now described by way of example.

DESCRIPTION OF THE PREFERRED EMBODIMENTS

EXAMPLE 1

Figure 1:
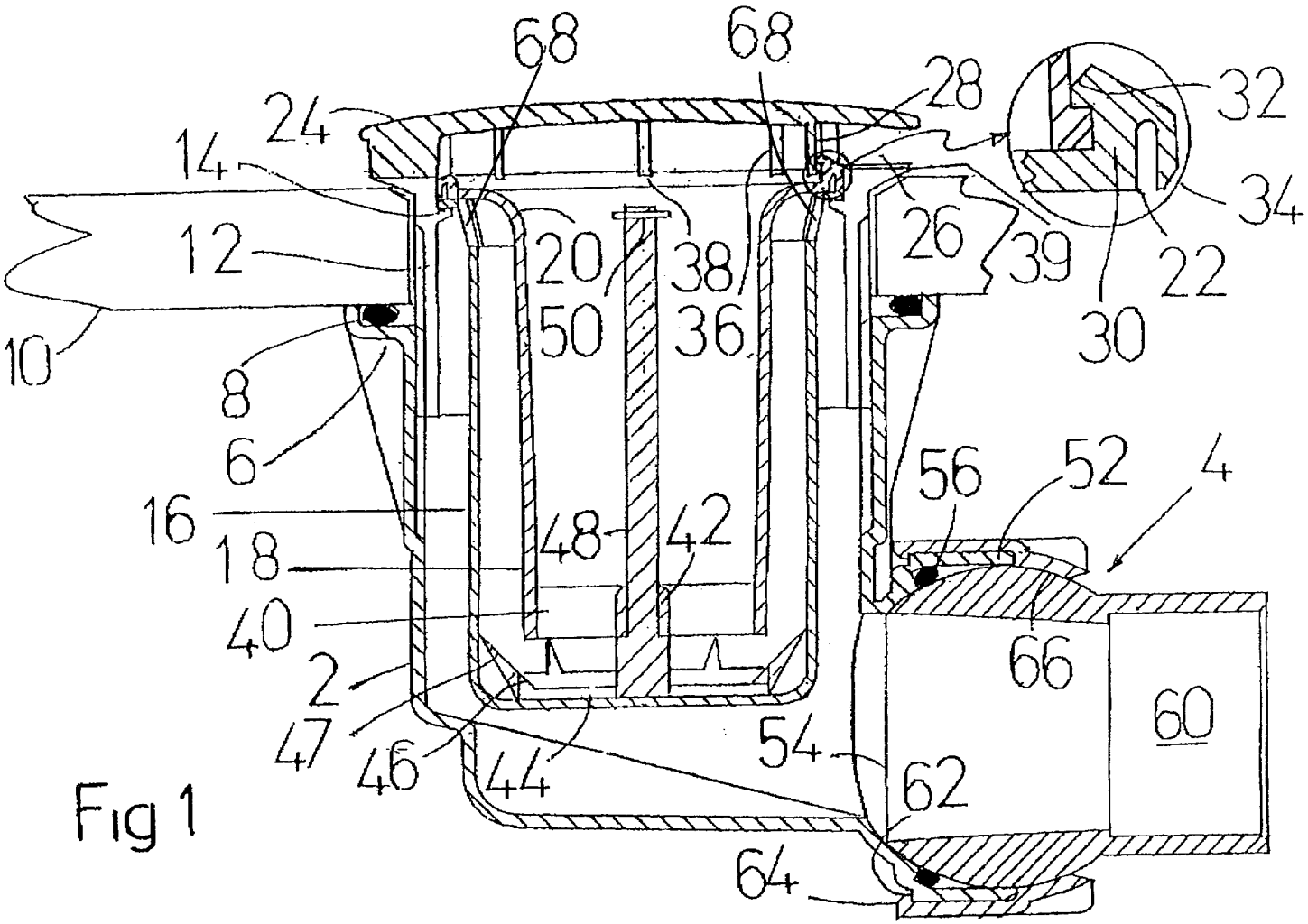
FIG. 1 is a section through the waste outlet for a shower tray with side entry of waste water.

With reference to the attached drawings the waste outlet consists of several injection moulded components made of ABS, polypropylene and HD polyethylene.

The cylindrical bowl 2 is 85 mm is dia, with a 45 mm dia outlet 4 lying at 90 degrees to the bowl axis. Annular flange 6 seats an O-rim 8 on the underside of the shower tray 10. A screw-in clamping ring 12 establishes a water tight seal with the tray. The ring also provides an inner seat 14 for a well 16 which occupies most of the bowl volume. A filler tube 18 has a flared mouth 20 which terminates in a resilient, inverted U-section rim 22. The rim sits on the well's inner seat 14 and is compressed slightly against the upstanding wall of the ring.

A convex cover 24 with side entries 26 for waste water, has four equispaced downwardly depending flanges 28. The flanges 28 snap beneath corresponding lugs 30 arranged on the rim 22, which have ramp faces 32. This is best seen in magnified insert 34. The periphery of the cover has a ring of radial lugs 36 which engage slots 38 moulded in the clamping ring flange 39.

The filler tube 18 has a spider 40 with a central bore 42. The spider acts as a coarse strainer. Rings and similar sized objects fall through the spider and collect on the filter disk 44. The disk resembles a circular tray with an oblique rim 46 which terminates in 24 resilient claws 47. These ride up the inside of the wall stripping debris as they go. A central stem 48 rides in the bore 42. Stop 50 on the stem allows the disk to hand 70 mm below the bottom of the tube when the pair are removed so the disk can be washed clean.

The outlet 4 has a plain spigot 52 with a tapered mouth 54. This creates a circumferential space into which an O-ring 56 is imprisoned by the ball 58 at the end of a stub tube 60. A 45 mm dia waste tube (not shown) is cemented to the stub. The spigot has a circumferential outer shoulder 62. A snap-on ring 64 has a socket surface 66 which cooperates with the tapered mouth 54 to seat the bore. The ring 64 has four snaps which engage shoulder 62. This arrangement seals effectively while allowing the ball to tilt about 30 degrees.

The filler tube and well define a water trap. Water is free to flow through the tube, deposit solids on the disk, rise up and exit through slots 68 in the top of the well whereafter the water flows under the well to reach the outlet 4.

The water seal is measured from the bottom of the funnel to the top of the reservoir.

EXAMPLE 2

This waste outlet has the same construction as FIG. 1 except that the spider is omitted and the water flows under the filler tube without restriction.

Instead the cover has drain holes 78 in the top and the central area 80 has a depending tube 82 with a pair of diametrically opposite slots 84. The stem 48 rides up and down in the tube 82 and a crosspin 86 enables the operator to withdraw the filler tube and the filter disk as a pair.

EXAMPLE 3

Figure 2:
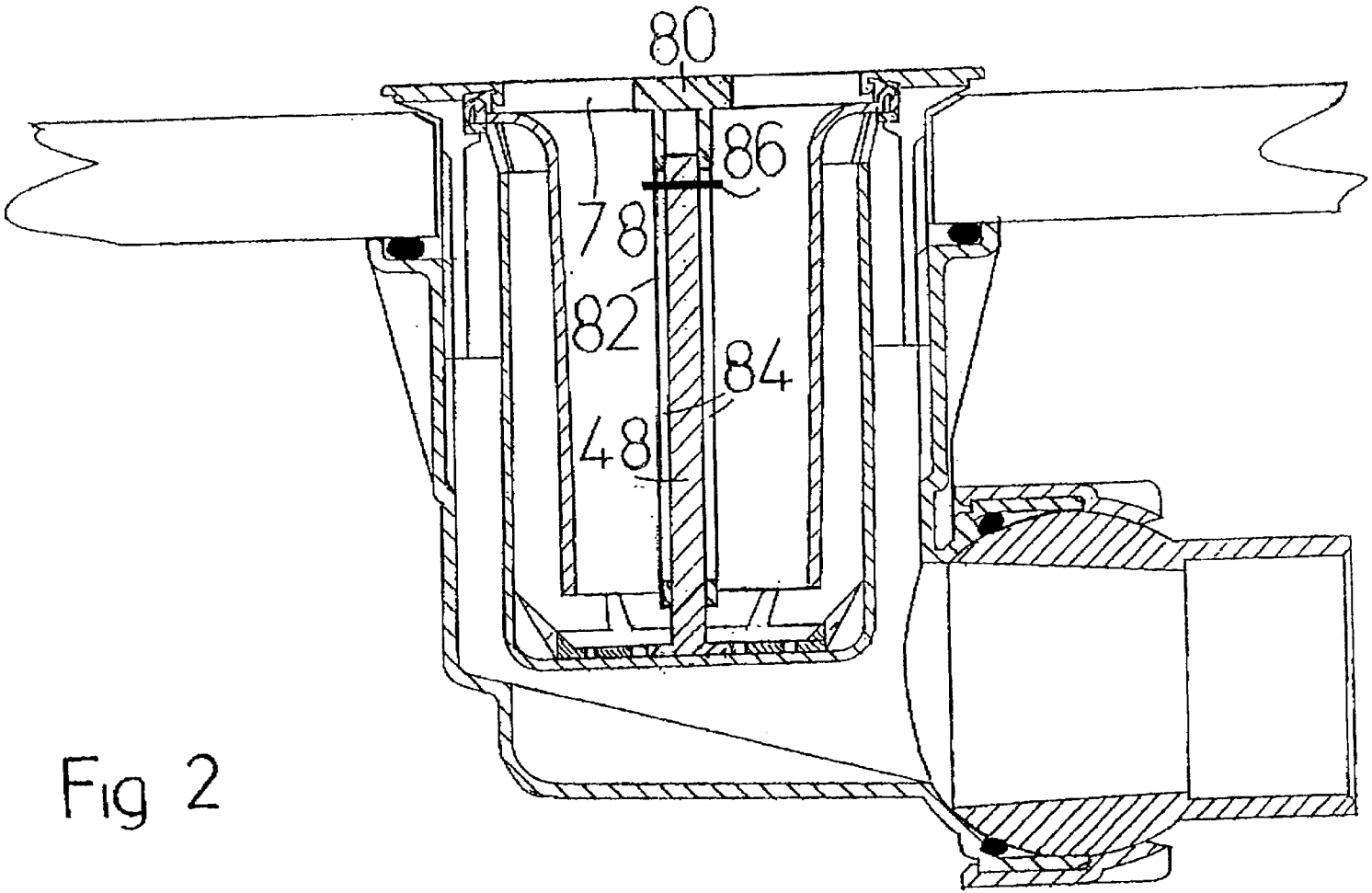
FIG. 2 is a section of a top entry version.
Figure 3:
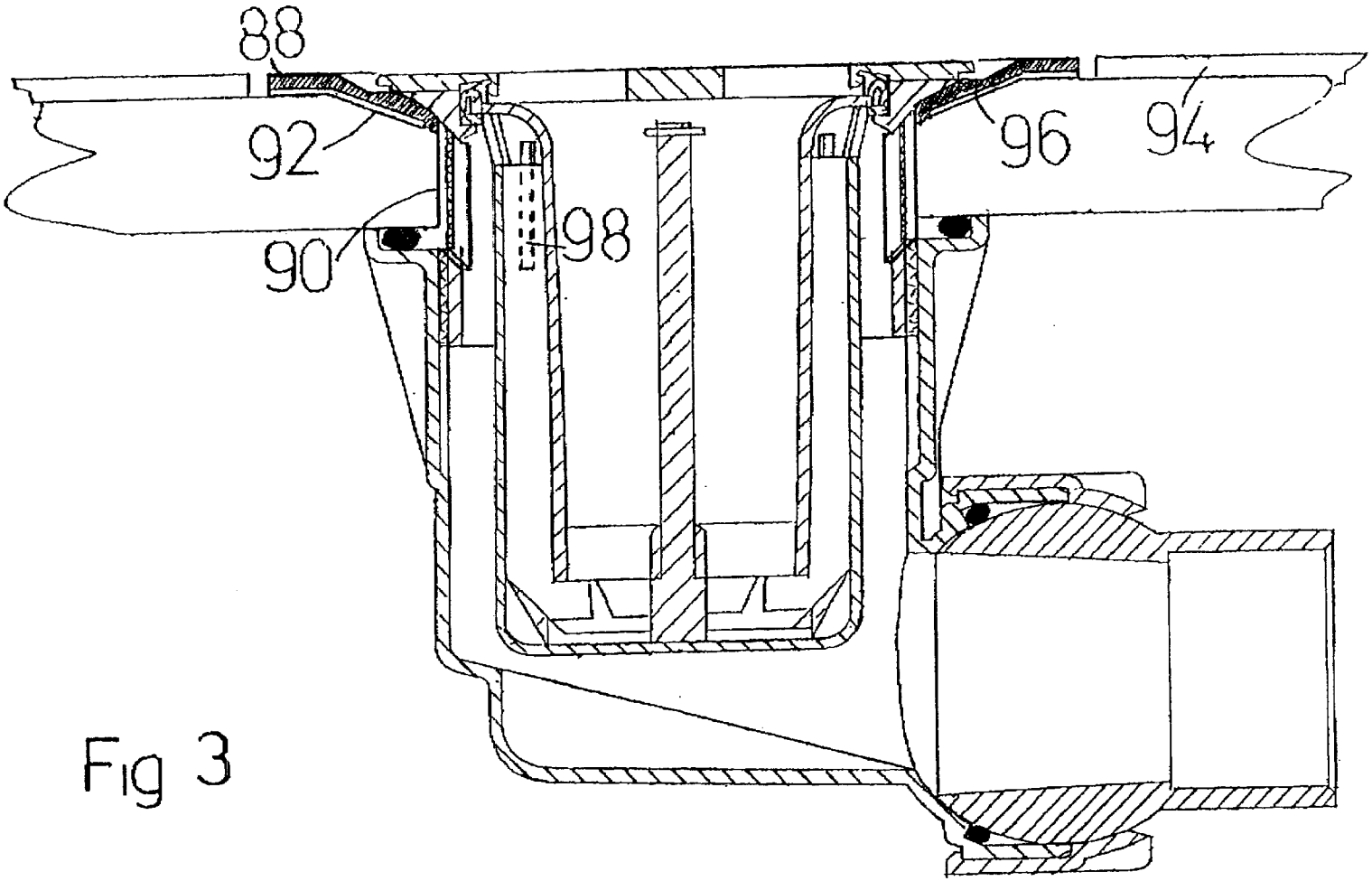
FIG. 3 is a section of a version for a shower floor slab.
Figure 4:
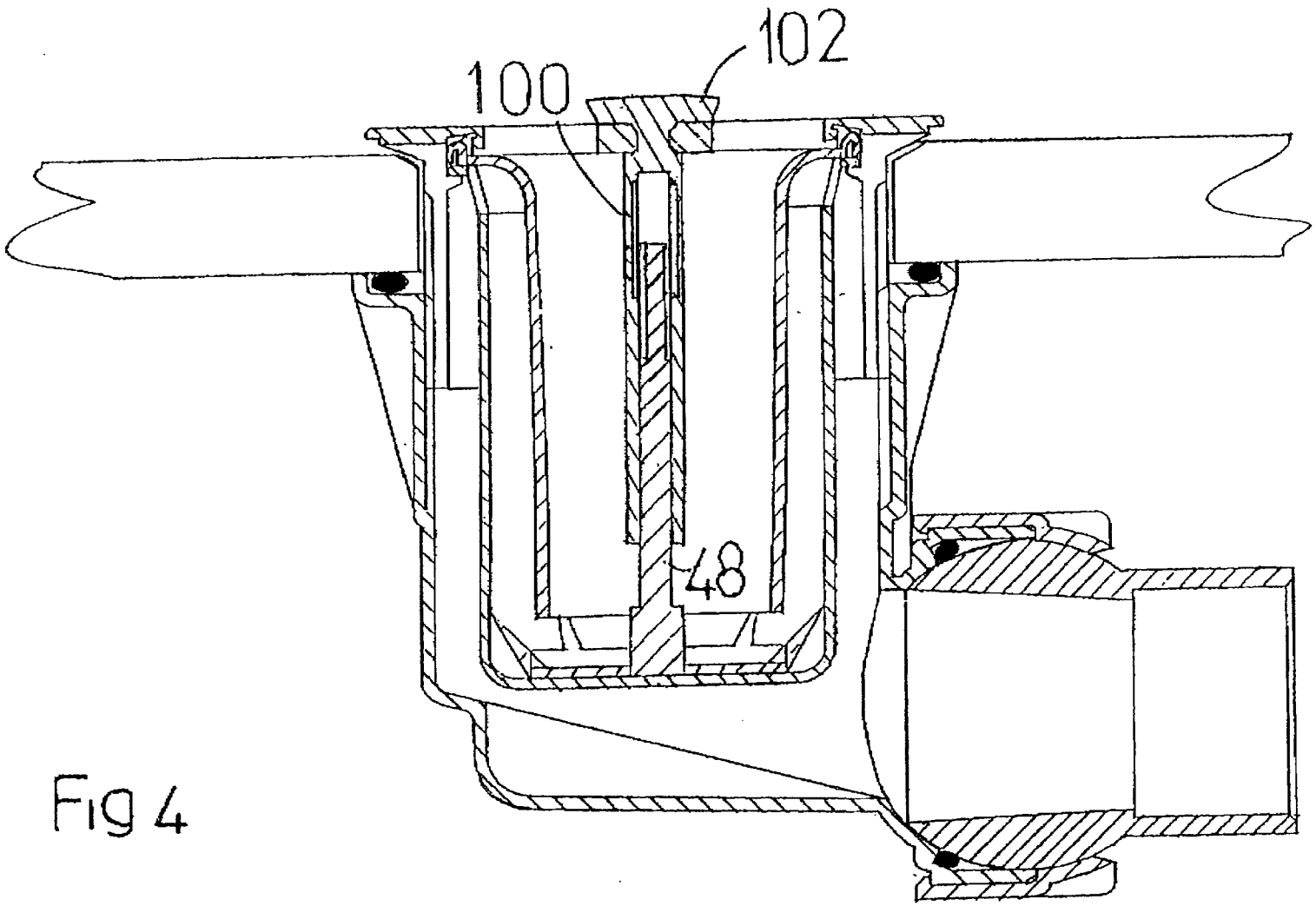
FIG. 4 is a section of a bath/pool version.

The waste outlet is the same as shown in FIG. 1 except that the cover is as shown in FIG. 2. The flange of the clamping ring imprisons a rectangular, polythene, drainage plate 88 between the ring flange 39 and the waste outlet cut out 90. This cutout is provided with a shallow cone rim 92 and the plate lies flush with tiles 94. The plate abuts the surrounding tiles being modular in size. The underside of the plate has a radial array of grooves 96 which drain the centre of the slab. After the shower has stopped flowing the tiles drain via the plate into the space around the fitting and then into the trap through vertical slots 98 in the clamping ring.

EXAMPLE 4

The waste outlet resembles FIG. 2 in that no spider is present. The stem 48 is threaded and a nut 100 turned by a knob 102 retracts the disk to seal against the underside of the filler tube. The disk has no perforations and merely acts as a stopper to retain water in a spa pool or bath, while continuing to provide the lift out filter facility.

1 I have found the advantage of the above embodiment to be that the filter is spaced from the bottom of the filler tube so that it can be washed to dislodge filtered solids.

2 The disc reveals any jewellery for retrieval.

I claim:

1. A waste outlet comprising a bowl with a drainage outlet which is capable of connection to a waste pipe, means to locate the bowl in relation to the surface to be drained, a removable drainage cover for the bowl, a water trap in the bowl and a lift-out filter in the water trap, the water trap comprising a well defined by an upstanding wall in the bowl and a coaxial filler tube which projects downwardly into the well and in use directs water from the cover into the well and establishes a permanent water seal and wherein the filter is connected to the filler tube so that the filter and the filler tube can lift out as a pair.

2. A waste outlet as claimed in claim 1 wherein the filter and filler tube nest in the well.

3. A waste outlet as claimed in claim 2 wherein the filter is the lower member of the pair and comprises a perforated disc and a post which allows the disc to hang beneath the filler tube while connected thereto, allowing solids to be washed from the disc.

4. A waste outlet as claimed in claim 3 wherein a filter support depends from the cover and the post rides on the support without the provisions of a spider.

5. A waste outlet as claimed in claim 3 wherein the perforated disc seats in the well and wipes the interior surface of the well when the disc is lifted out of the well.

6. A waste outlet as claimed in claim 5 wherein the periphery of the disc flexes in order to seal the against the interior surface of the well.

7. A waste outlet as claimed in claim 6 wherein the bowl drainage outlet has a plain spigot and a ball located in the spigot, the ball having a socket for the drain tube, a ball-retaining ring which coaxially overlaps the spigot and has a ball contact section which urges the ball against the bowl outlet aperture and an O-ring imprisoned between the outlet and the ball.

8. A waste outlet as claimed in claim 7 wherein the spigot has a circumferential reaction surface and the ball has retainer sites which snap over the reaction surface.

9. A waste outlet as claimed in claim 7 wherein the O-ring is housed in a space defined by the ball, the bowl outlet aperture and the spigot.

10. A waste outlet as claimed in claim 6 wherein the disc circumference has flexible claws which trap hair.

11. A waste outlet as claimed in claim 10 wherein the filler tube depends from the underside of the cover and removal of the cover also removes the filter and the filler tube in a string.

12. A waste outlet as claimed in claim 1 wherein the filler tube has an entrance surrounded by an annular flange and the flange rim has a U-section for spring insertion into a clamping ring.

13. A waste outlet as claimed in claim 12 wherein the clamping ring receives and locates the entrance of the filler tube.

14. A waste outlet as claimed in claim 13 wherein the well is a receptacle within the bowl and there is a flow space between the bowl and the receptacle.

15. A waste outlet as claimed in claim 14 wherein the well has an annular flange which seats on the mouth of the clamping ring.

16. A waste outlet as claimed in claim 15 wherein the annular flange of the well and the mouth of the clamping ring form a seat for the rim of the filler tube.

17. A waste outlet as claimed in claim 16 wherein the cover has an underside with depending lugs which engage the rim of the filler tube.

18. A waste outlet as claimed in claim 17 wherein the lugs and parts of the rim have corresponding ramp faces which snap together.

19. A waste outlet as claimed in claim 17 wherein said bowl has a flange and further lugs depend from the underside of the cover and radial slots in the bowl flange receive said lugs to prevent rotation of the cover.

20. A waste outlet as claimed in claim 1 wherein the filter and filler tube lift out seriatim.

21. A waste outlet as claimed in claim 1 wherein the filler tube has a spider which defines a bore through which a post projects and the post has a stop which engages the spider enabling the filter and filler tube to be lifted out as a pair.

* * * * *